United States Patent [19]

Allison et al.

[11] Patent Number: 5,059,110

[45] Date of Patent: Oct. 22, 1991

[54] APPARATUS FOR FORMING CONCRETE BLOCKS HAVING PLURAL SEPARATELY DRIVEN VIBRATOR SETS

[75] Inventors: J. Dennis Allison, Camas; Robert A. Schmitt, Vancouver, both of Wash.

[73] Assignee: Columbia Machine, Inc., Vancouver, Wash.

[21] Appl. No.: 383,054

[22] Filed: Jul. 21, 1989

[51] Int. Cl.[5] ..... B28B 1/08; B28B 3/06

[52] U.S. Cl. ..... 424/260; 425/344; 425/355; 425/421; 425/432; 425/448

[58] Field of Search ..... 425/219, 260, 352, 355, 425/421, 424, 432, 448, 456, 344

[56] References Cited

U.S. PATENT DOCUMENTS

| | | | |
|---|---|---|---|
| 2,589,115 | 3/1952 | Nelson et al. | 425/432 |
| 2,819,046 | 1/1958 | Jandris et al. | 425/432 |
| 2,842,827 | 7/1958 | Nickelson | 425/432 |
| 2,859,502 | 11/1958 | Brown, Jr. | 425/432 |
| 2,985,935 | 5/1961 | Wellnitz | 425/432 |
| 3,331,112 | 7/1967 | Clanton et al. | 425/448 |
| 3,343,239 | 9/1965 | Davies | 425/432 |
| 3,659,986 | 5/1972 | Gelbman | 425/88 |
| 3,712,785 | 1/1973 | Hirt et al. | 425/405.1 |
| 4,111,627 | 9/1978 | Kitahara | 425/421 |
| 4,193,754 | 3/1980 | Sekiguchi | 425/424 |
| 4,238,177 | 12/1980 | Crile et al. | 425/432 |
| 4,265,609 | 5/1981 | Kitahara | 425/260 |
| 4,445,839 | 5/1984 | Crane | 425/432 |

OTHER PUBLICATIONS

Columbia Machine, Inc. Bulletin, "Model 15½ Block Machine", 1982.

Columbia Machine, Inc. Bulletin, "Model 16 HF Floor Level 3-Block Machine", 1984.

Columbia Machine, Inc. Bulletin, "Model 22 HF Floor Level Block Machine", 1987.

Columbia Machine, Inc. Bulletin, "Model 50 Block Machine", 1986.

Columbia Machine, Inc. Bulletin, "Model 60 Block Machine".

Columbia Machine, Inc. Bulletin, "Model 1600 Block Machine", 1986.

*Primary Examiner*—James C. Housel

*Attorney, Agent, or Firm*—Marger, Johnson, McCollom & Stolowitz

[57] ABSTRACT

Apparatus and method for continuously forming concrete blocks or pavers comprises a frame for defining a supporting structure with a mold box flexibly mounted thereon, the mold box having internal cavities contoured to define preselected block patterns, wherein a feed device for receiving concrete material is operable for selective positioning over an upper surface of the mold box for investing concrete material into the cavities. First and second sets of vibrators are mounted, respectively, generally at opposite ends of the mold box and are operable for being selectively driven by associated first and second power drives. The first and second power drives are selectively operable for synchronizing or independently actuated the first and second sets of vibrators, respectively, so that concrete material invested into the cavities of the mold box may be vibrated so that the concrete material is evenly distributed in substantially equal masses throughout the cavities in the mold box.

15 Claims, 8 Drawing Sheets

APPARATUS FOR FORMING CONCRETE BLOCKS HAVING PLURAL SEPARATELY DRIVEN VIBRATOR SETS

BACKGROUND OF THE INVENTION

The present invention relates to machines for manufacturing concrete blocks, and more particularly to a novel method and apparatus for forming blocks and pavers by ensuring that they are formed with a uniformly compacted density.

In the production of concrete blocks and pavers, it is conventional to use large block forming machines which vibrate and compress concrete material dispensed into a mold. After compression, the concrete blocks or pavers are stripped from the mold and taken to a suitable curing station, after which time the product is shipped.

One type of concrete block forming device is disclosed in Davies (U.S. Pat. No. 3,343,239). There, a mold box is supported above a pallet holder, suitably mounted in a frame structure, and a single vibrator rod is mounted on opposite sides of the mold box and connected thereto for imparting vibration to the mold box. The vibrator rods are connected adjacent their lower ends to a rotatable shaft which imparts vibration to the vibrator rods for vibrating the mold box. Vibration is used in an attempt to evenly distribute concrete material within the mold box.

Other examples of various types of vibrating apparatus for forming concrete blocks are disclosed in Sekiguchi (U.S. Pat. No. 4,193,754), Kitahara (U.S. Pat. No. 4,111,627), Gelbman (U.S. Pat. No. 3,659,986) and Hirt, et al. (U.S. Pat. No. 3,712,785). Each of these patents discloses some type of device for vibrating a mold or concrete product to effectuate a uniform mold fill. Additionally, there are systems which utilize rotatable vibrators connected to a pallet table, such as systems using electric vibrators (motors with eccentric weights built into them) usually in pairs which run in counter-opposing directions.

SUMMARY OF THE INVENTION

In forming concrete blocks with machines, such as described above, and in those which use some type of feed drawer for filling a mold box, a particular problem resides in that the feed drawer will not evenly distribute concrete material into each of the cavities of the mold box. This is because as a feed drawer passes over a mold box, material which initially is displaced into the first cavities become more compacted than material which is displaced into downstream cavities. Then, when the feed drawer is retracted, it may leave an uneven profile of concrete material in the mold box, i.e. there may be more material at one end than in the other. Therefore, it becomes advantageous to provide some type of vibration which will ensure uniform distribution of the concrete material in the mold box, and it may be important to vibrate the concrete material during compression also.

To that end, it is a general object of the present invention to provide a method and apparatus for continuously forming concrete blocks which provides controlled and selective vibration of a filled mold box, at opposite ends thereof, to ensure even distribution of concrete material, i.e., that each cavity in the mold box is filled with the same mass of material. Specifically, the method and apparatus of the present invention utilizes a central, self-supporting block forming section defined by a frame means which supports a mold box non rigidly mounted thereon. A feed means, such as a feed drawer or the like, is isolated from contact with the mold box operable for receiving concrete material, and is selectively positionable over an upper surface of the mold box for investing or filling concrete material into the cavities thereof. A principal feature of the present invention is the incorporation of spaced-apart vibrator rods which are mounted generally at opposite ends of the mold box. The first pair of vibrator rods is driven by a first power driven means, and the second pair of vibrator rods is driven by a second power driven means. Each of the power driven means is selectively operable for synchronizing or independently actuating the first and second pairs of vibrator rods, respectively. The result is that if it is determined that the mold box is filled unevenly, one of the pairs of vibrator rods may be shut down and the other operated, or in any selected sequence. The point is that each pair is independently driven by a variable speed drive and can be synchronized during all phases of a production cycle or synchronized for a portion of such a cycle, or run independently for the remainder.

Another object of the present invention is to provide a method and apparatus as described above, in which first and second feed drawers are mounted adjacent the frame means and selectively operable for independent, rectilinear shifting from positions remote from the mold box to corresponding positions thereabove. This means that concrete blocks or pavers may be made having a color "cap" for decorative purposes. Explaining further, with the sectional design of the present invention, a first feed drawer may be disposed over the mold box for investing material thereinto, and after retraction of that feed drawer, the other may be moved into position for investing different colored concrete material on top of that already in the mold box.

These and additional objects and advantages of the present invention will be more readily understood after a consideration of the drawings and the detailed description of the preferred embodiment.

DETAILED DESCRIPTION OF THE PREFERRED EMBODIMENT

At the outset, it was stated that the present invention is directed to a method and apparatus for continuously forming concrete blocks. To that end, as shown in FIG. 1 of the drawings, an apparatus according to the present invention is generally designated at 10, and includes a sectional design, comprising a first feed drawer assembly generally indicated at 12, a central block forming section generally indicated at 14 and a second feed drawer assembly generally indicated at 16, which is provided for 30 the optional capability of producing blocks or pavers having a color "cap." Block forming section 14 is designed as a self-supporting unit symmetrical about its own centerline, and the first and second feed drawer assemblies also are individual and separate units which are mounted on power-driven wheels so that they may be rolled away for easy maintenance.

Figure 1:
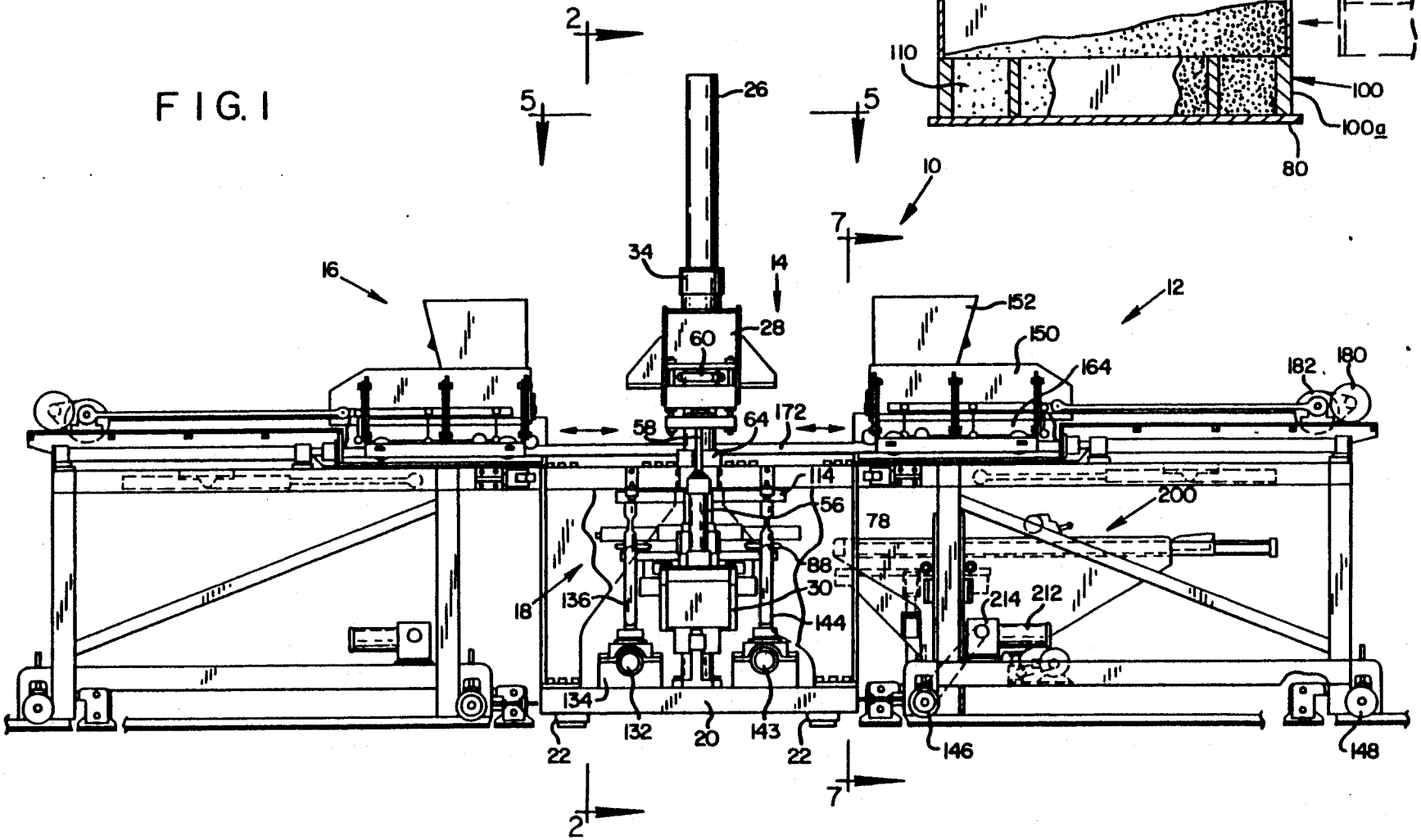
FIG. 1 is a side elevational view of the apparatus of the present invention, showing a central block forming section flanked by opposed, feed drawer assemblies.
Figure 2:
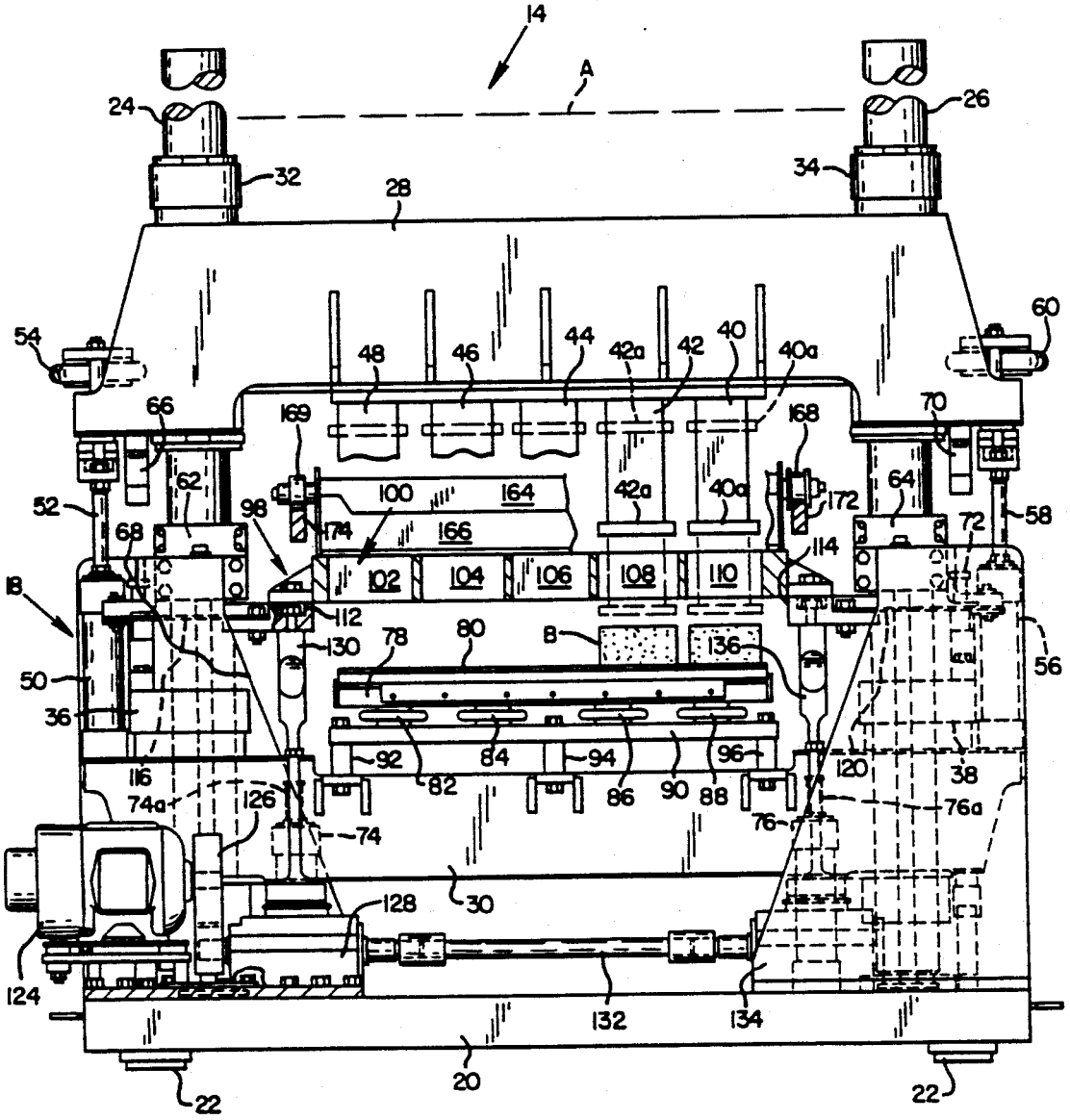
FIG. 2 is a view taken along section lines 2—2 of FIG. 1, and illustrates in detail the construction of the central block forming section.

Initially, attention will be directed to a description block forming section 14, with reference not only to FIG. 1, but also FIG. 2. As shown in FIG. 1, the block forming section includes a box-like frame means generally indicated at 18, which includes interconnected upright members and cross-beams, etc. It will be noted that frame means 18, which includes a base means indicated at 20, is mounted on vibration isolators 22. As shown in FIG. 2, block forming section !4 is provided with a pair of opposed, upstanding guide columns 24, 26 which slidably receive a transversely-extending compression beam 28 and a main or stripper beam 30 disposed therebeneath. Compression beam 28 is provided with upper bushings 32, 34 and stripper beam 30 is provided with bushings 36, 38. Compression beam 28 is provided with a plurality of downwardly extending shoes, such as indicated at 40–48 which are configured for compressing concrete material and ejecting the formed product that from the cavities in a mold box in a manner to be described. Each of the shoes is provided with a base plate, such as indicated at **40*a*, 42*a* etc. Dashed line A shown adjacent top of FIG. 2 represents the maximum extent to which compression beam 28 will be raised, and at that position, the base plates, such as indicated at 40*a*, 42*a***, etc. are shown in their upper positions.

Mounted on opposite ends of stripper beam 30 are fluid-actuated cylinders and associated rods operable for vertically shifting compression beam 28 relative to the stripper beam. Specifically, as shown to the left of FIG. 2, cylinder 50 is vertically mounted on the stripper beam and is selectively operable for extending rod 52, which in turn is coupled to compression beam 28. An air bag for providing vibration isolation is shown at 54, which cushions action of compression beam 28 and its associated components in operation. Similarly, on the right hand side of FIG. 2, a cylinder 56 includes a rod 58 connected to an end of compression beam 28. An air bag is also shown at 60, mounted on an extension from rod 58. Additional bushings, such as indicated at 62 and 64, mounted on frame means 18, are provided for slidably receiving guide columns 24, 26 respectively. Mounted on the left side of compression beam 28 is a downwardly extending projection 66 bolted thereto which will engage a stop 68 to limit the extent to which the compression beam can be moved downwardly. Similarly, to the right of compression beam 28, as shown in FIG. 2, a projection 70 is mounted which will engage stop 72 to limit downward movement of the compression beam. Further, it will be noted that stripper beam 30 is vertically shiftable relative to the frame means by means of stripper cylinder/rod assemblies 74, 76, mounted adjacent opposite ends of the stripper beam. As illustrated in FIG. 2, as well as in FIGS. 1 and 3, 4, stripper beam 30 is in its fully retracted position. The cylinder/rod assemblies 74, 76 are mounted so that their associated rods **74*a*, 76*b*** engage the stripper beam and are operable for selectively raising and lowering the stripper beam.

It will be noted that stripper beam 30 supports a pallet table 78 which in turn provides a mount for a pallet, such as that indicated at 80. A pallet for receiving concrete blocks or pavers typically is formed from one half inch steel plate. The pallet table is mounted by means of vibration isolators, such as air bags 82–88 to a saddle 90 which, in turn, is mounted to the stripper beam by means of spacer/bracket assemblies 92, 94 and 96.

Attention will now be directed to the specific construction of the vibration means which is positioned in block forming section 14 and suitably connected to a mold box for imparting vibration thereto. A mold box is shown in cross section at 100 in FIG. 2, with internal cavities, such as indicated at 102–110 contoured to define preselected block or paver patterns. The mold box is suitably mounted, at opposite sides thereof, to spaced-apart guide supports shown at 112, 114. The guide supports are, in turn, non rigidly mounted to the frame means by elongate, metallic plate springs which may flex. Specifically, as can be seen in FIG. 2, along with a viewing of FIG. 4, plate springs 116, 118 non rigidly and flexibly interconnect guide support 112 to the frame means. Similarly, viewing the right side of FIG. 2, and also FIG. 3, it can be seen that plate springs 120, 122 flexibly interconnect guide support 114 to the frame means.

As shown at the bottom left of FIG. 2 (see FIG. 4 also), a first power driven means 124 is suitably mounted on the frame means, and is interconnected by a timing belt drive 126 to a vibrator housing 128 which includes an internal eccentric arrangement for imparting vibration to a vertically extending vibrator rod 130, which is bolted to guide support 112 as shown. Viewing the bottom of FIG. 2, it can be seen that a horizontally extending first shaft means 132, which is driven by first power driven means 124, extends from vibrator housing 128 to vibrator housing 134 which in turn is provided with an eccentric arrangement to impart vibration to vibrator rod 136 which is bolted to guide support 114. Similarly, a second power driven means 138 (see FIG. 4) is suitably coupled to a vibrator housing 140 for imparting vibration to vibrator rod 142 and, via a second shaft means 143, imparting vibration to vibrator rod 144 (see FIG. 3). Thus, what has been described are first and second sets of vibrators mounted, respectively, generally at opposite ends of the mold box. The vibrators are defined by a first pair of spaced-apart, vertically extending vibrator rods 130, 136 each having one end thereof connected to the mold box and the other end to first power driven means 124. The second set of vibrators is defined by a second pair of spaced-apart vertically extending vibrator rods 142, 144, each also having one end thereof connected to the mold box and the other to second power driven means 138.

It can be appreciated that first pair of vibrator rods 130, 136 can either be synchronized or operated independently from the second pair of vibrator rods 142, 144. This becomes important when it is understood that it is desirable to have the flexibility of imparting vibration to the mold box, after its been filled, or to impart vibration to one end of the mold box as will become apparent when the operation of the apparatus is described. However, first it is necessary to describe the feed drawer assemblies 12, 16. Initial reference is made with respect to FIG. 1, which shows first feed drawer assembly 12 mounted on a frame structure which in turn is mounted on wheels, such as indicated at 146, 148 (and wheels on the opposite sides thereof) for enabling movement along a track, thereby to shift the assembly away from central block forming section 14 when it is desired to clean or maintain the unit.

Figure 6:
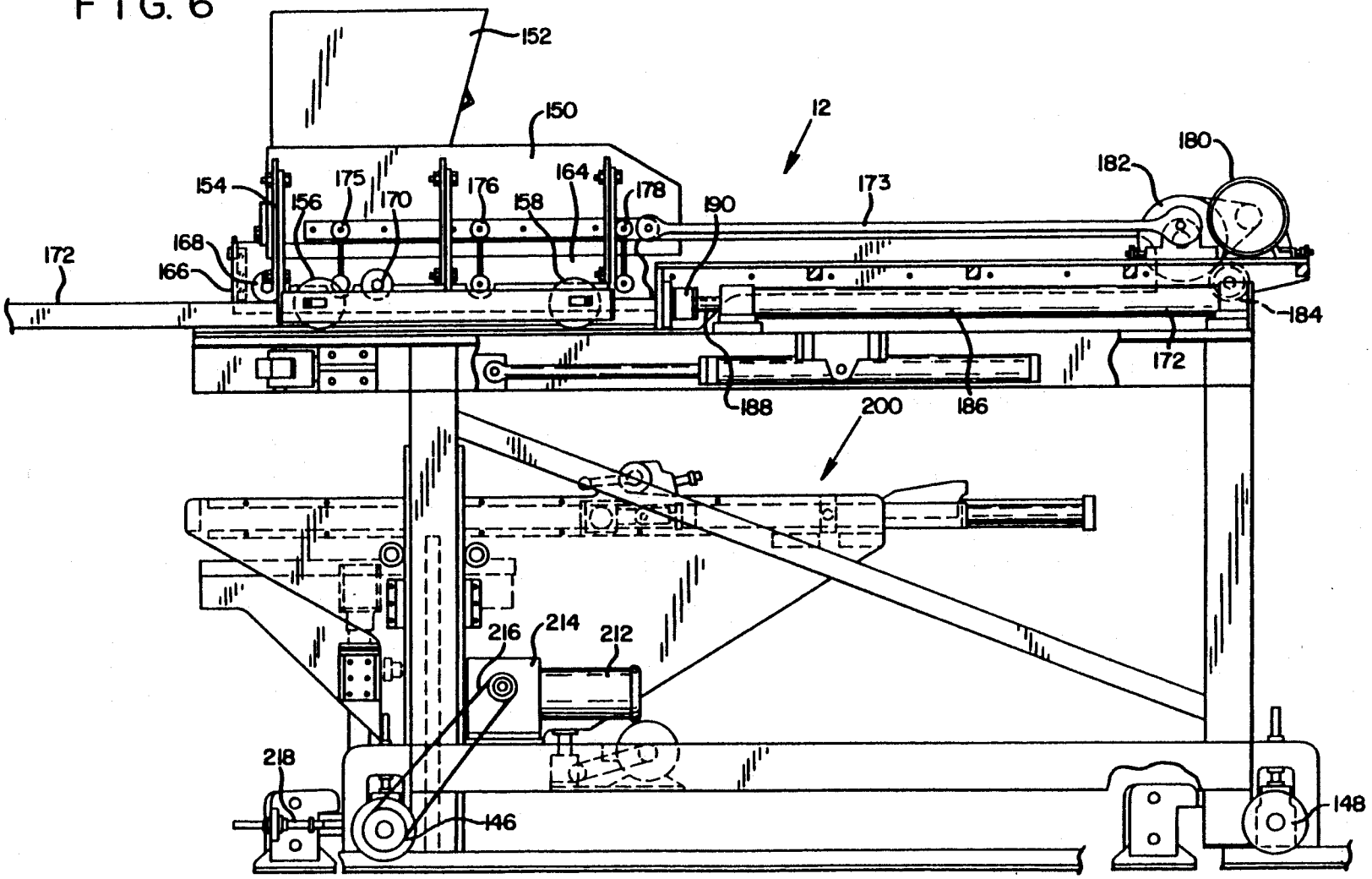
FIG. 6 is a side elevational view of a first feed drawer assembly.
Figure 7:
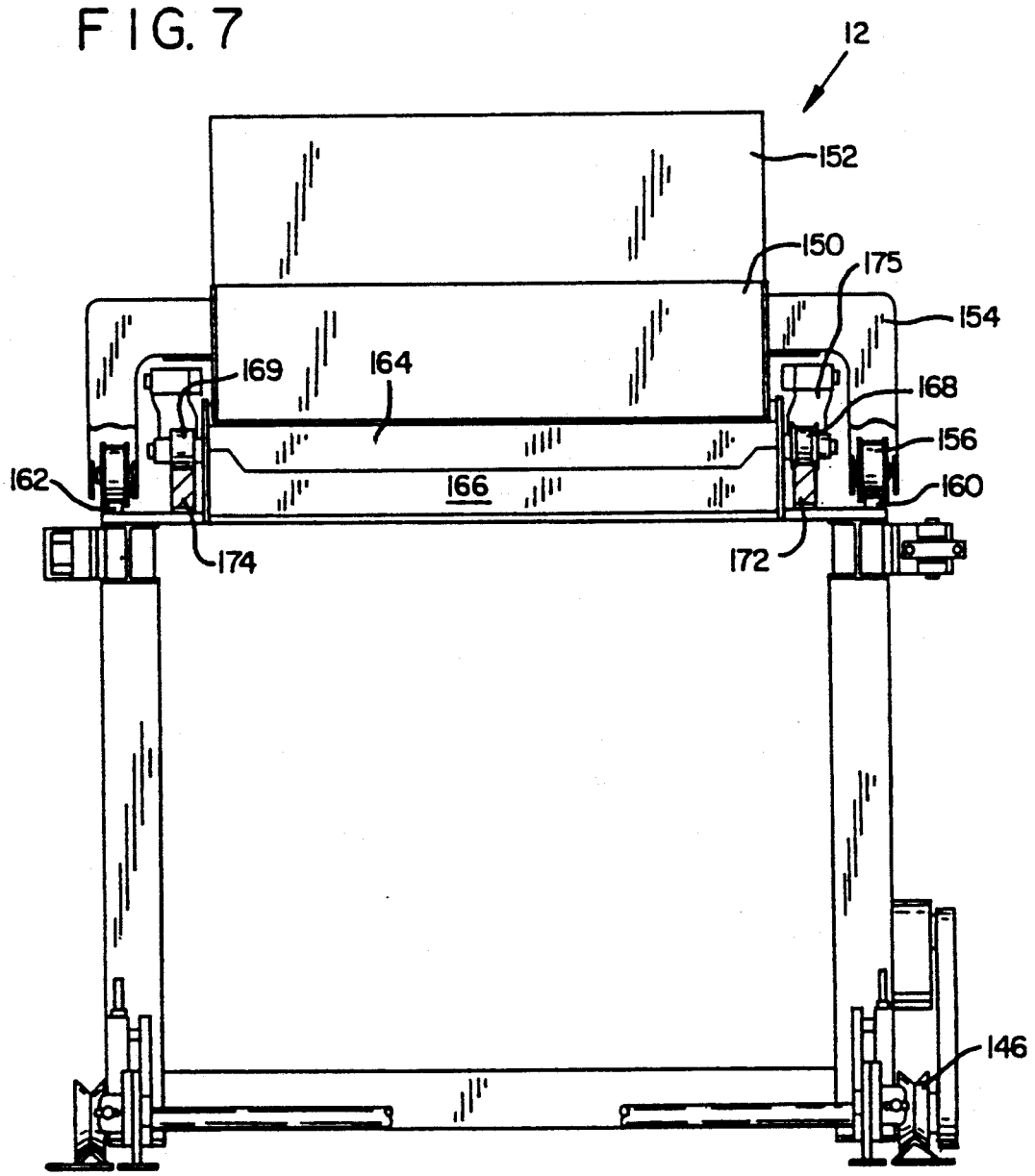
FIG. 7 is a view taken along lines 7—7 of FIG. 1 and illustrates an end view of the first feed drawer assembly.

As shown in FIG. 6, first feed drawer assembly 12 comprises a normally stationary box 150 having a hopper 152 mounted thereon. Extending from opposed sides of box 150 are arms 154 (see also FIG. 7) which are journaled to a pair of wheels on each side, such as wheels 156, 158 shown in FIG. 6. The wheels on both sides of box 150 are moveable along associated tracks, such as tracks 160, 162 as shown in FIG. 7. Disposed beneath box 150 is a relatively shiftable feed drawer, which will be referred to as first feed drawer 164. The first feed drawer is provided with a vertically adjustable "strike-off" or screed plate 166. Additionally, the first feed drawer is provided with wheels 168, 170 and counterparts thereof on the opposite side, such as wheel 169. The wheels ride on tracks 172, 174 as also shown in FIG. 7. An elongate agitator rod 173 is suitably connected via a series of pivotally connected links 175, 176 and 178 which are in turn connected to agitating fingers disposed inside of the first feed drawer. Agitator rod 172 is driven by a motor 180 which is connected to an eccentric pulley 182 thereby to oscillate the links and the fingers to agitate concrete material inside of feed drawer 164 and box 150. It will also be noted that motor 180 and eccentric pulley 182 are mounted on a frame which includes wheels, such as rear wheel 184 for travel along track 172. An opposite wheel is provided for travel along rail 174. A fluid powered cylinder 186 is operable for extending and retracting a rod 188 and an associated engaging element 190 for selectively extending the first feed drawer to the left relative to box 150, when viewing FIGS. 1 and 6, and for returning the feed drawer to the position shown in FIG. 6. The idea is that concrete material will be dispensed into hopper 152 and box 150 and then into the feed drawer. The feed drawer is bottomless, but concrete material is retained by a plate provided on the frame structure, when the feed drawer is positioned to the right as shown in FIG. 6. When the feed drawer is shifted to the left so that it is positioned over mold box 100, concrete material will be invested thereinto as will be described. As shown in FIG. 2, first feed drawer 164 has traveled along tracks 172, 174 to a position over the mold box.

Figure 8:
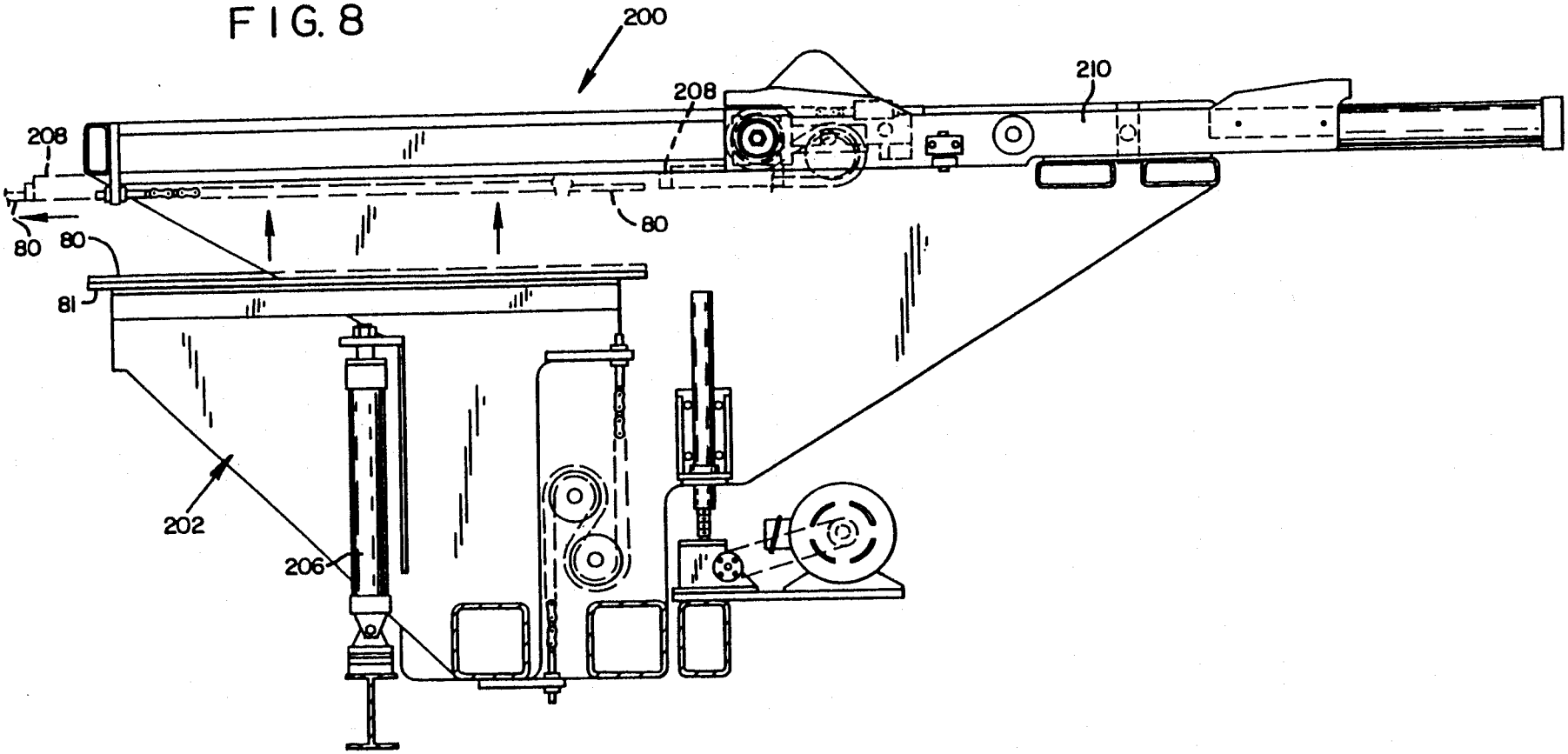
FIG. 8 is a side elevational view of a pallet feed assembly isolated from its normal mounting in the first feed drawer assembly.

Returning to FIG. 1, the reader will note that track 172 is shown extending through central block forming section 14. It will be noted that to the left of FIG. 1, the second feed drawer assembly comprises a structure similar to that just described for the first feed drawer assembly 12, except it does not include a pallet feeder assembly such as generally indicated at 200 in FIG. 1. That feeder assembly, as it is shown in FIG. 8, will now be described.

Specifically, pallet feeder assembly 200 comprises a lifting means generally indicated at 202 which will receive pallets, such as indicated at 80, 81, etc. The lifting means is powered by a lifting cylinder/rod assembly 206 so that the pallet may be shifted upwardly, as indicated by the arrows so that the pallet will be raised to the position indicated at 80. Thereupon, a pusher rod 208 is selectively actuated by a power driven cylinder 210 to engage an end of the pallet and shift it to the left, so that the pallet will be displaced onto the pallet table. It is also to be noted from FIGS. 1 and 6 that a motor 212 is suitably interconnected via a gear box 214 and transmission means 216 to wheel 146 so that the first feed drawer assembly and supporting frame may be shifted away from central block forming section 14. A similar construction is provided for second feed drawer assembly 16. As shown in FIG. 6, a locking/release mechanism interconnecting the systems is shown at 218. Lastly, while rail 172 is shown in FIGS. 1 and 6 as being continuous, the rails will in fact be comprised of separate, alignable sections to enable the first and second feed drawer assemblies to be shifted away from central block forming section 14 when maintenance or repair is required.

OPERATION

Figure 3:
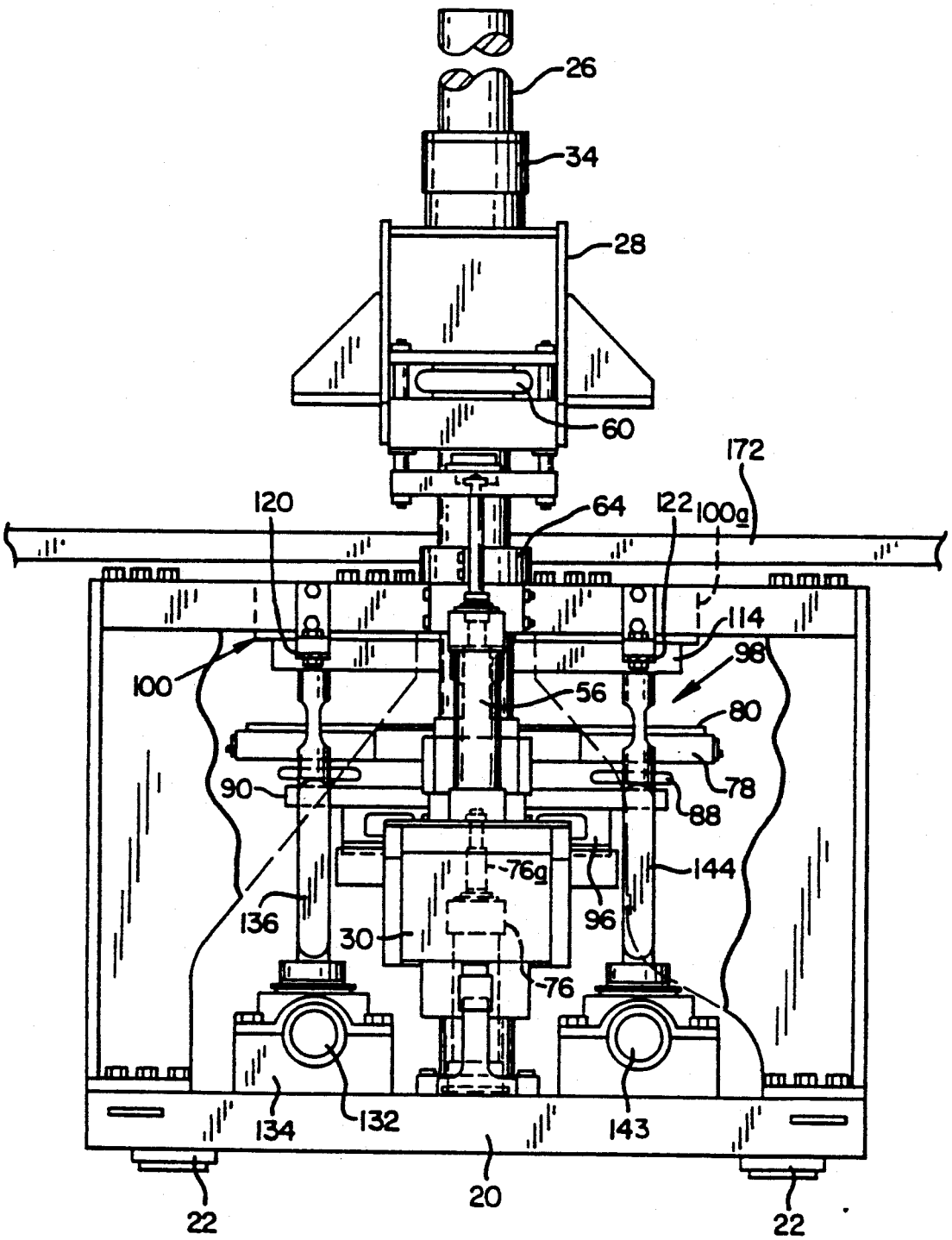
FIG. 3 is an isolated view of one side (facing the viewer in FIG. 1) of the central block forming section.
Figure 4:
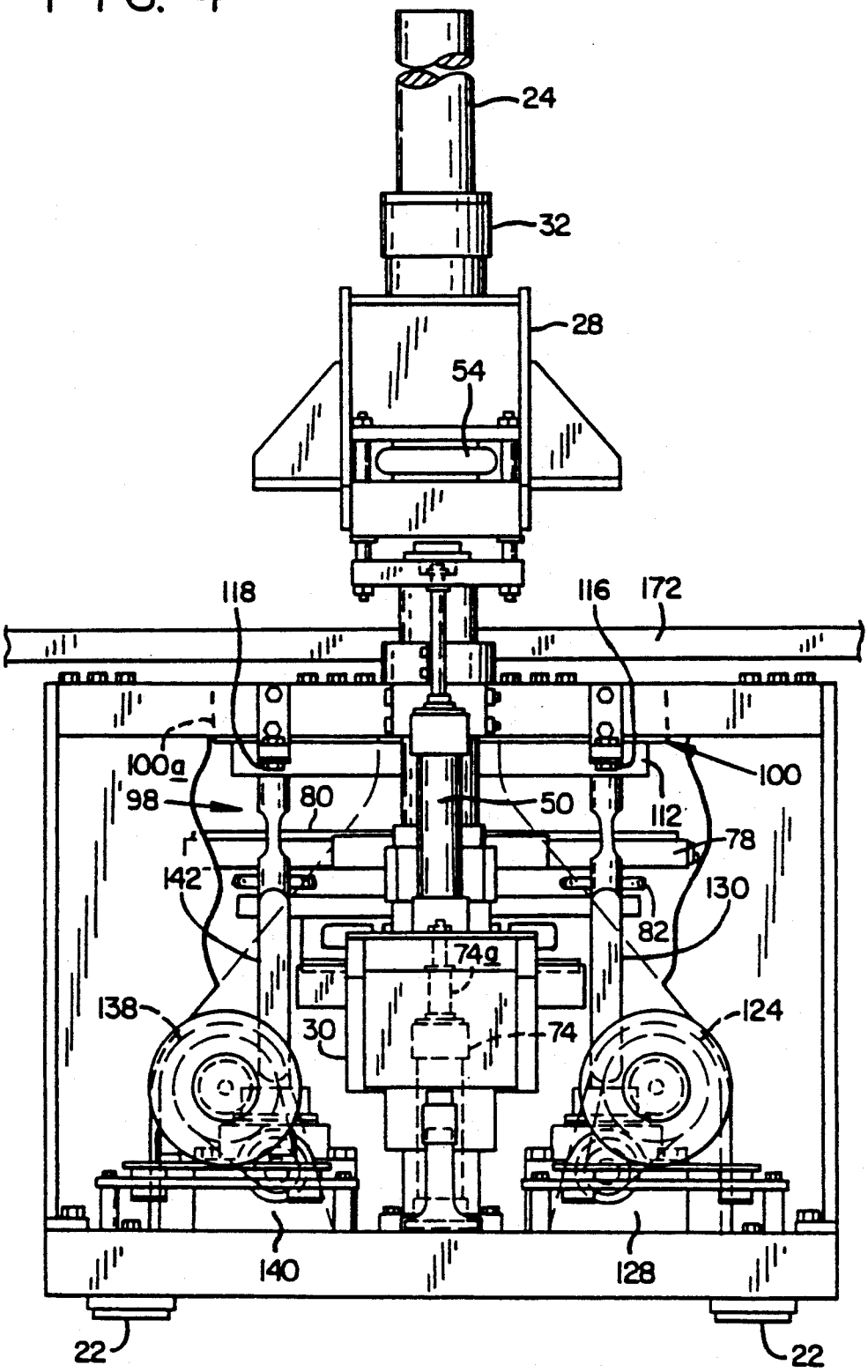
FIG. 4 is an isolated view of the other side of the central block forming section.
Figure 5:
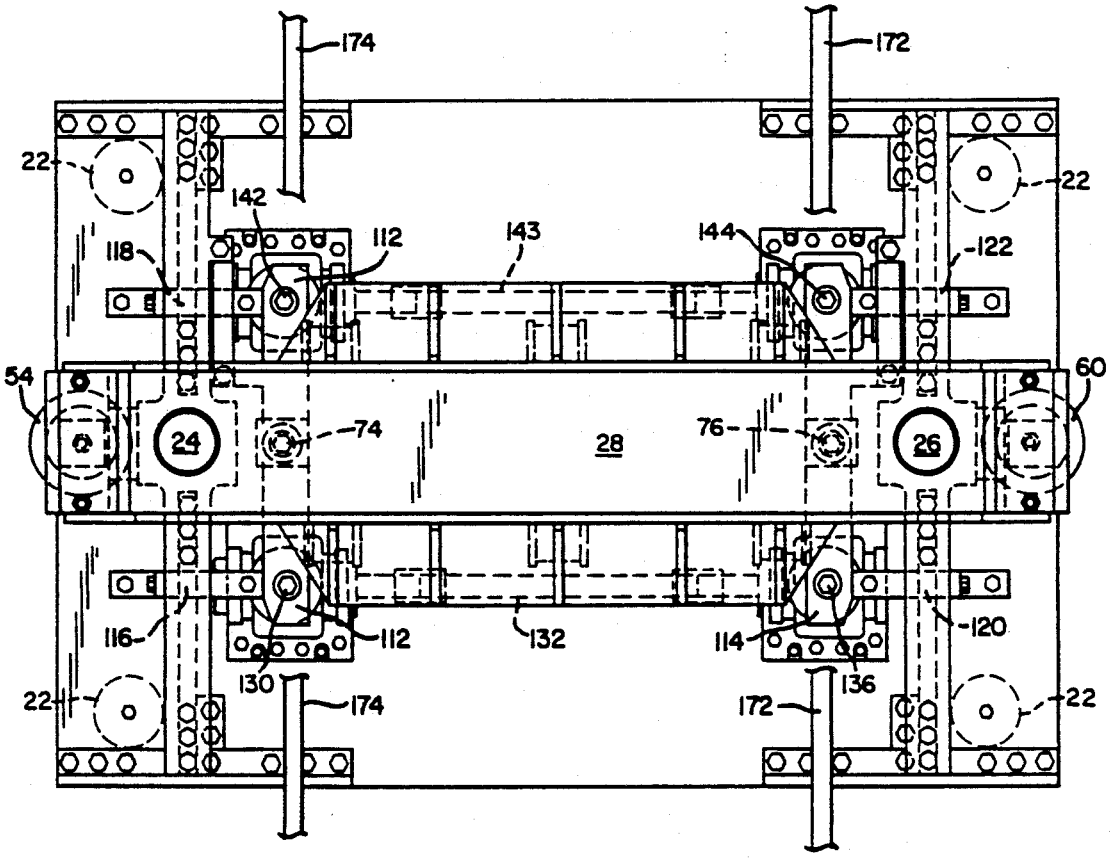
FIG. 5 is a top plan view, taken along lines 5—5 of FIG. 1 and illustrates an isolated view of the central block forming section.

The method of operation of the apparatus of the present invention, in the forming of concrete blocks, provides several distinct and important advantages. In one mode of operation, where a color cap is not provided, the steps generally are as follows. First, with reference to FIG. 2, it will be noted that stripper beam 30 is retracted via cylinders 74, 76 into its lowest position. Cylinders 50, 56 are actuated so as to extend their corresponding rods 52, 58, respectively, to displace compression beam 28 so that it extends to the position indicated at A in FIG. 2. With the stripper beam in its lowest position, pallet feeder assembly 200 is actuated to shift a pallet onto pallet table 78. A pallet is disposed in that position as shown in FIGS. 2–4. At that point, cylinders 74, 76 are actuated to vertically displace stripper beam 30 so that the top of pallet 80 is positioned directly beneath mold box 100.

First feed drawer 164, filled with concrete material, is then shifted toward block forming section 14, i.e., to the left with reference to FIGS. 1 and 6. As the front edge or the screed plate of the first feed drawer begins to pass over the leading edge **100*a* of the mold box (see FIG. 3), concrete material is dispensed into the first cavities of the mold box, and as the first feed drawer continues moving over the mold box, the remaining cavities are filled with concrete material. During the investing step, agitator rod 173 is actuated so that the concrete material is continuously stirred up. FIG. 2 shows positioning of first feed drawer 164 over mold box 100 after the first feed drawer has traveled along rails 172, 174. Because the feed drawer is bottomless, it has displaced concrete material into the individual cavities, such as those indicated at 102, 104, 106, etc. The concrete material fills each cavity substantially, and pallet 80** forms a bottom retainer.

Figure 9:
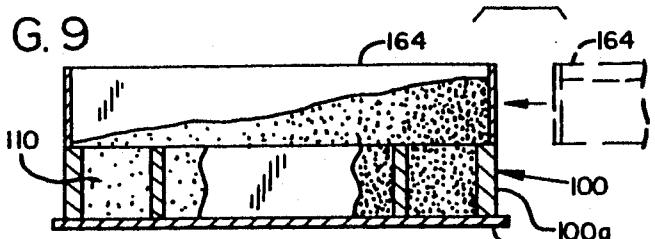
FIG. 9 is an isolated, schematic view, partially broken away, showing the first feed drawer disposed over the mold box.

An enlarged and broken-away schematic view of the first feed drawer above the mold box is shown in FIG. 9. As can be seen, the mass of concrete material will not be evenly distributed in each cavity, inasmuch as those cavities which are initially filled will have a greater density than those subsequently filled. That is because the concrete material within the first feed drawer is deepest over the initially filled cavities, resulting in a denser mass there. Specifically, the density of concrete material will be less in the cavities to the left, such as indicated at 110. Those cavities closest to the leading edge 100*a* of the mold box will have a more dense initial compaction of concrete material. However, it is desired to even out the densities in the cavities, so that each contains an equal mass of material.

Accordingly, with the first feed drawer disposed over the mold box during the investing step (as shown in FIGS. 2 and 9), first and second power driven means 124, 138 are now actuated to impart vibration to first pair of vibrator rods 130, 136 and second pair of vibrator rods 142, 144, respectively. As a result of the vibration, concrete material is vibrated and shifted so that it becomes more evenly displaced in the cavities. Nevertheless, if an operator determines that the concrete material is not evenly distributed, or if it is desired to redistribute that material or change its profile within the mold box, then the second pair of vibrator rods 142, 144 may be deactuated while the first pair of vibrator rods 130, 136 continues in operation. Vibrator rods 130, 136 are furthest from the cavities which were initially filled, and continued operation of those rods results in more vibration in the downstream end of the mold box ensuring more even distribution of material. This may be accomplished with feed drawer 164 positioned above mold box 100. Either pair of the vibrator rods may be actuated, with the other shut down, to achieve a desired distribution of concrete material.

Next, after first feed drawer 164 is retracted, so that screed plate 166 drags excess material rearwardly (or to the right when viewing FIG. 1), the pairs of vibrator rods may be run independently or simultaneously to "profile" the material as desired in the mold box. Alternatively, during retraction of the feed drawer, neither pair of vibrator rods may be operated. The point here is that an operator has the capability of selectively operating the system to command a desired profile in the mold box.

After first feed drawer 164 has been fully retracted, the compression step occurs as follows. Compression cylinders 50, 56 are actuated to retract their associated rods 52, 58 to a position whereby shoes 40*a*, 42*a*, etc. are directed downwardly into the cavities of mold box 100 to compress and compact the concrete material. During this compression stage, typically all four of the vibrator rods may be driven for vibration of the mold box, or alternatively, a selected pair may be activated while the other pair is shut down. In any case, it is contemplated that it is preferable to provide vibration and compaction simultaneously, and synchronization or independent operation of the first and second power driven means is possible depending upon the circumstances. After compression beam 28 has been lowered to the position whereby projections 66, 70 engage corresponding stops 68, 72, cylinder/rod assemblies 74, 76 are actuated to lower pallet table 78 which thereby receives the compacted and formed blocks or pavers, such as shown at B, these products now being "stripped" from the mold box.

Another process utilizing the present invention contemplates producing blocks or pavers having a different colored top or color "cap." To that end, first feed drawer 164, provided with base material of concrete, initially invests or fills the mold box. Vibration means 98 may be suitably actuated to provide vibration, as above described. After first feed drawer 164 has been retracted, the feed drawer of second feed drawer assembly 16, filled with concrete material having a different color, is shifted into position so that the new material is dispensed on top of the original base material, thereby providing a color cap. The second feed drawer is withdrawn, and compression beam and stripper beams are then actuated for providing the compression and strip-off steps, as described above. Again, vibration may be provided as needed whenever necessary. Pavers having such a color cap are highly decorative, and find many applications in sidewalks, mall areas, etc.

The pairs of vibrator rods are mounted on their associated eccentric drives so that they can travel over a range of 80/1000 of an inch from bottom dead center (BDC) to top dead center (TDC). Thus, the mold box can correspondingly be moved that distance, or by suitable command, some selected shorter distance. Further, one end of the mold box may be moved relative to the other by suitably commanding operation of a selected pair of the vibrator rods. An operator has flexibility to adjust the distribution of concrete material in the mold box to provide even distribution. The profile of the concrete material can be varied as the feed drawer is retracted. It is important to note that it is the mold box which has vibration imparted thereto.

From the above description and outline of the operational sequences available with the method and apparatus of the present invention, it should be apparent that several important and significant advantages are readily achieved. First, an apparatus is provided with sectional design, i.e. a central block forming section is positioned between first and second feed drawer assemblies, and all three are separable enabling only one or both feed drawers to be used. Because the first and second power driven shafts of the vibration means turn in counter-opposing directions, a balanced design results, and contributes to accurate mold fill and product compression characteristics.

A principal advantage of the present invention is the mounting of first and second pairs of vibrator rods which are secured to the mold box, generally at opposite ends thereof. With each of the first and second pairs being driven by its own independent power driven means, in counter-opposing directions, each pair may be synchronized with the other or operated independently. This means that if a mold box is filled unevenly, one of the pairs may be operated for a longer cycle than the other. The goal is to place the same mass of material in each cavity of the mold box, and to even out densities of material in those cavities. The density profile of concrete material which remains in the mold box, after retraction of the feed drawer, can be evened out even further during compression, i.e. the vibrator rods can be actuated during the actual compression step wherein the compression beam moves the shoes against concrete material during compression.

The present invention has been described above without illustrating any specific control devices, hoses, wiring, etc. All of those features are considered to be well within the purview of those having ordinary skill in the art.

Another advantage of the present invention resides in the provision of rails or tracks which extend from one feed drawer assembly through the central block forming section and continue on into the second feed drawer assembly. It is not necessary that the rails, such as indicated at 172, 174 actually form continuous members, but rather that a rail system is provided so that feed drawers which are laterally opposed on opposite sides of the mold box may be operable for rectilinear shifting therealong from a first position remote from the mold box to a second position disposed directly thereabove so that the investing step may take place. It is important to note that the positioning of rails 172, 174 effectively isolates the feed drawers from the mold box. Because the mold box, in turn, is located in position by flexible mounts such as plates 116-120, vibration imparted to the mold box essentially is not imparted to the rails and the feed drawers. This is important because if a feed drawer is vibrated, the material therewithin becomes more compacted, meaning that it will not flow as readily therefrom into the mold box.

While selected operational times are available, a typical sequence might involve imparting vibration during the investing step for approximately 2–3 seconds. After investment, only one pair of the vibrators may be run for about one second. Different sequences are available according to type of concrete material, etc.

While the present invention has been shown and described with reference to the foregoing preferred embodiment, it will be apparent to those skilled in the art that other changes in form and detail may be made therein without departing from the spirit and scope of the invention as defined in the appended claims.

It is claimed and desired to secure by Letters Patent:

1. Apparatus for continuously forming concrete blocks comprising:

frame means for defining a supporting structure;

a mold box having internal cavities contoured to defined preselected block patterns;

means for flexibly mounting said mold box on said frame means comprising a substantially planar plate spring having a first end connected to said mold box and a second end connected to said frame means;

means for fixing the lateral position of said mold box, feed means for receiving concrete material operable for selective positioning over an upper surface of the mold box for investing concrete material into the cavities;

vibration means defined by first and second sets of vibrators mounted, respectively, generally at opposite ends of the mold box; and first and second power driven means selectively operable for synchronizing or independently actuating the first and second sets of vibrators, respectively.

2. The apparatus of claim 1 wherein the first set of vibrators is defined by a first pair of spaced-apart, vertically extending vibrator rods each having one end thereof connected to the mold box and the other end to the first power driven means, wherein the second set of vibrators is defined by a second pair of spaced-apart, vertically extending vibrator rods each having one end thereof connected to the mold box and the other to an associated second power driven means.

3. The apparatus of claim 2 wherein the first and second sets of vibrators are positioned in tandem relative to one another.

4. The apparatus of claim 3 further including a horizontally extending first shaft means for interconnecting and synchronizing operation of the first pair of vibrator rods, and a horizontally extending second shaft means for interconnecting and synchronizing operation of the second pair of vibrator rods.

5. The apparatus of claim 4 wherein the frame means includes a rail means dimensioned for extending horizontally and above the mold box, and wherein the feed means is defined by a feed drawer assembly selectively operable for rectilinear shifting along the rail means from a first position remote from the mold box to a second position disposed directly above the mold box thereby to invest concrete material into the mold box cavities.

6. The apparatus of claim 4 wherein the feed means is defined by first and second feed drawers, each dimensioned for receiving concrete material, and each mounted on the frame means and selectively operable for sequential rectilinear shifting from positions remote from the mold box to positions above the mold box.

7. The apparatus of claim 6 wherein the frame means includes elongate track means dimensioned for extending over and laterally outwardly of opposite ends of the mold box, the first and second feed drawers being mounted on the track means and operable for selective, reciprocal shifting therealong.

8. The apparatus of claim 2 wherein said power driven means include rotatable shafts and wherein said shafts counterrotate relative to one another when said apparatus is in operative condition.

9. The apparatus of claim 1 wherein said apparatus further includes means for actuating said first power driven means while said second power driven means remains unactuated and means for actuating said second power driven means while said first power driven means remains unactuated.

10. The apparatus of claim 1 wherein said mold box is substantially rectangular and wherein said plate spring is substantially normal to the mold box side from which it extends.

11. The apparatus of claim 1 wherein said mold box is substantially rectangular and wherein said means for fixing the lateral position of said mold box comprises a second substantially planar plate spring extending between another side of said box and said frame means.

12. The apparatus of claim 1 wherein said frame means defines a frame having a vertical axis about which it is symmetrical.

13. The apparatus of claim 12 wherein said apparatus further includes means for preventing frame vibrations from being transmitted to said feed means.

14. Apparatus for continuously forming concrete blocks comprising:

frame for defining a supporting structure, said frame having a vertical axis about which it is symmetrical;

a mold box having internal cavities contoured to defined preselected block patterns;

means for flexibly mounting said mold box on said frame means comprising a substantially planar plate spring having a first end connected to said mold box and a second end connected to said frame; and means for fixing the lateral position of said mold box;

a feed drawer assembly having a first feed drawer for receiving concrete material, said assembly being detachably connected to said frame for shifting said feed drawer from a first position remote from said mold box to a second position disposed directly above said mold box thereby to invest concrete material into said mold box cavities;

vibration means defined by first and second sets of vibrators mounted, respectively, generally at opposite ends of the mold box; and first and second power driven means selectively operable for synchronizing or independently actuating the first and second sets of vibrators, respectively.

15. The apparatus of claim 14 said mold box is substantially rectangular and wherein said plate spring is substantially normal to a mold box side from which it extends.

* * * * *

UNITED STATES PATENT AND TRADEMARK OFFICE

CERTIFICATE OF CORRECTION

PATENT NO. : 5,059,110

DATED : October 22, 1991

INVENTOR(S) : J. Dennis Allison and Robert A. Schmitt

It is certified that error appears in the above-identified patent and that said Letters Patent is hereby corrected as shown below:

Title page, item [56] under "References Cited" the following patents should be listed:
U.S. Patent No. 2,706,320 to Davies et al.;
U.S. Patent No. 2,396,999 to George;
French Patent No. 2,493,214; and
French Patent No. 2,478,519.

Column 3, Line 13: Delete "30";

Line 28: Change "!4" to --14--;

Column 5, Line 33: Change "172" to --173--;

Column 10, Line 60: Change "the" to --said--; and

Line 63: Change "the" to --said--.

Signed and Sealed this

Nineteenth Day of October, 1993

Bruce Lehman

*Attest:*

BRUCE LEHMAN

*Attesting Officer*

*Commissioner of Patents and Trademarks*